United States Patent [19]

Moudgil et al.

[11] 4,235,708

[45] Nov. 25, 1980

[54] METHOD OF SEPARATING A MIXTURE OF ORE PARTICLES

[75] Inventors: Brij M. Moudgil, Ontario; Booker W. Morey, Pasadena; David F. Messenger, Pomona, all of Calif.

[73] Assignee: Occidental Research Corporation, LaVerne, Calif.

[21] Appl. No.: 897,947

[22] Filed: Apr. 19, 1978

[51] Int. Cl.[2] ..... B07C 5/02

[52] U.S. Cl. ..... 209/3.3; 209/576

[58] Field of Search ..... 209/3.1, 3.2, 3.3, 1, 209/3, 4, 9, 578, 576, 577, 580–582, 587, 589; 427/158, 160

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson et al. | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1974 | Sawyer | 209/3.1 |
| 3,992,287 | 11/1976 | Rhys | 209/2 |

*Primary Examiner*—Allen N. Knowles

*Attorney, Agent, or Firm*—Barry A. Bisson

[57] ABSTRACT

A method of separating a mineral component from particulate ore consisting of many components, such as oxides, silicates, carbonates, sulfides etc. is disclosed. The particulate ore is conditioned with a surface-active agent capable of selectively coating one of the components of the ore to the substantial exclusion of coating the other components. A coloring agent having an affinity towards the coating of surface active agent is combined with the surface active agent, providing the coated ore particles with a distinguishable color from the non-coated ore particles. The distinguishable color-coated ore particles are separated from the non-coated ore particles.

14 Claims, No Drawings

METHOD OF SEPARATING A MIXTURE OF ORE PARTICLES

BACKGROUND OF THE INVENTION

The present invention relates to a method for the separation of minerals from an ore. More particularly, it relates to a method of separating the components of an ore by distinguishing between a difference in color provided to the particular ore components due to their differing surface chemical properties. This invention further relates to a method of separating limestone from limestone ore containing iron-bearing rock, chert, granite, quartz, and other silicates.

Current methods of optically sorting minerals from the ore in which they are contained utilize the naturally occurring differences in color or reflectivity of the various components of an ore. Using this naturally occurring difference in coloration, the components of the ore can be separated by optical sorting techniques. However, some problems are presented with such current optical sorting techniques. One problem encountered in separating the components of an ore is the occurrence of a range of colors for a valuable mineral component of the ore. Such a range of colors for the valuable mineral component of an ore can overlap a range of colors for the nonvaluable components e.g. both limestone and quartz can be essentially of the same color and reflectivity. In the optical sorting of the various components of an ore, in reliance upon the naturally occurring differences in color and reflectivity, some of the nonvaluable components are sorted along with the valuable mineral components and some of the valuable mineral components are discarded as gangue.

Further, when there is an overlap of the range of colors and reflectivity for the valuable and nonvaluable mineral components there is a sacrifice of percent yield when purity of the valuable component is desired and correspondingly there is a sacrifice of percent purity when a high yield of valuable component is desired.

Another disadvantage of optically separating components of a mineral ore by the naturally occurring differences in color or reflectivity of the individual components is that such a separation method is limited to use on only those mineral ores wherein the individual components exhibit such a substantially noticeable difference in color or reflectivity.

Separating mineral components by their naturally occurring differences in color or reflectivity is currently conducted by sorting the various components by hand or machine which senses visible light. Such sorting is limited to the ability of the individual to discern optical differences such as colors and/or reflectivity. Hand sorting of the components of the mineral ore is typically a job for unskilled labor. Due to this level of skill of the laborer and the tediousness of the job, there is generally a high turnover rate for such hand-sorting operations. Unfortunately, the ability to separate the components of an ore by hand-sorting techniques requires extensive training of the individuals conducting the hand sorting in order to obtain products of value from the operation.

It is the general practice to separate limestone from the other components present in limestone ore by methods that distinguish between the physical properties of the limestone and such other components. The term "gangue" will be used hereinafter to refer to the nonvaluable components present within an ore. For example, the nonvaluable mineral components comprising gangue from a limestone containing ore are impurities such as chert, iron-bearing rock, granite, quartz, and various other silicates. The methods used to separate limestone from gangue present in limestone ore include hand-sorting or other optical sorting methods. Hand-sorting is slow and tedious and is economically unattractive. The other optical sorting methods are limited because of difficulty in the resolution of colors and reflectivity and the difficulty of distinguishing among the various shades of colors and reflectivity presented by the limestone and gangue in the ore. In particular, limestone and quartz present in limestone ore are difficult to optically separate due to their similarity in color as both components are generally white or grey in color.

SUMMARY OF THE INVENTION

In accordance with this invention, there is disclosed a method for the separation of the mineral components within a particulate ore. The particulate ore is conditioned with a surface-active agent capable of selectively coating one of the components of the ore to the substantial exclusion of coating the other components. A coloring agent, preferably a solid coloring agent, having an affinity toward the surface active agent is applied to adhere to the surface active agent in a quantity sufficient to provide the coated ore particles with a distinguishable reflectivity and/or color which is different from the color and/or reflectivity of the non-coated ore particles.

A method of separating a mixture of higher grade limestone from lower grade limestone and the silicate containing gangue present in particulate limestone are comprising the steps of:

(a) conditioning the particulate limestone ore with at least one surface active agent selected from the group consisting of aliphatic amines containing from about 8 to about 22 carbon atoms and beta amines containing from about 7 to about 21 carbon atoms, said surface active agent selectively coating the silicates in the gangue to the substantial exclusion of coating the calcium carbonate containing particles;

(b) combining with said surface active agent a coloring agent selected from the group consisting of carbon black, activated charcoal and mixtures thereof for providing the coated silicate containing gangue and lower grade limestone particles with a grayish-to-black color, leaving the higher grade limestone particles substantially in their natural color; and (c) separating the gray to black gangue and lower grade limestone particles from the higher grade limestone particles.

A method for the separation of higher grade limestone particles from lower grade limestone particles and the gangue present in particulate limestone ore comprising the steps of:

(a) conditioning the particulate limestone ore with at least one surface active agent selected from saturated and unsaturated carboxylic acids containing from about 4 to about 22 carbon atoms, said surface active agent coating the calcium carbonate in the limestone to the substantial exclusion of coating the gangue;

(b) combining with said surface active agent a coloring agent selected from the group consisting of activated charcoal, carbon black and mixtures thereof for providing the coated limestone particles with a gray to black color, leaving the gangue particles substantially in their natural color; and (c) separating the higher grade black limestone particles from the lower grade gray limestone particles and the gangue.

DETAILED DESCRIPTION OF THE INVENTION

The method of the present invention is based upon differences in the surface chemical properties of the various components present in ores. Due to these differences there can be selected a surface active agent or a mixture of surface active agents that will effectively, selectively coat only certain components present in an ore. Separation based upon surface chemical properties provides relatively more consistent separation results than separation methods based upon other properties such as color, reflectance, and conductivity. Such other properties generally tend to be substantially similar for the various components of an ore, such that a fine degree of resolution is required in order to distinguish between these properties for the various materials present in an ore. Such a fine degree of resolution may be difficult to obtain. Therefore, the efficiency of separation based upon these properties suffers.

Added with the surface active agent, to distinguish between the surface active agent-coated components of the ore and the non-coated components, is a coloring agent. A coloring agent is selected which has an affinity towards the coating of surface active agent and which provides upon absorption a substantially distinguishable color from the naturally occurring color of the components of the ore. The surface active agent can also be the coloring agent. The coloring agent need not exhibit the distinguishable color until it adheres to the surface active agent, such as by interaction with the surface active agent to provide the color.

In the practice of the method of this invention in regard to a particular mineral ore, the ore is first subjected to a crushing step. In this crushing step, the ore is crushed to physically separate the components present within the ore. For example, some ores exist with stratifications and/or pockets of the various components and crushing of the ore as mined is a means for physically separating these stratifications and/or pockets. Crushing also increases the surface area of the particles, thereby providing a greater reactive site with which the surface active agent can react. The ore is crushed, typically to a particle size of from about one-quarter inch to about eight inches. Particle sizes of less than one-quarter inch can be used in the practice of this invention, however, such sizes require greater amounts of surface agent and are more difficult to separate requiring greater amounts of time for separation for a given mass of ore. Particle sizes of greater than eight inches can be used in the practice of this invention but generally such particle sizes entrain such a substantial mixture of components that separation efficiency decreases. It is preferred to use ore particles of a size from about one-half inch to about three inches. Following the crushing and sizing steps, the ore particles can be deslimed to remove soluble impurities and surface fines which can be present on the particulate ore.

The ore is conditioned following sizing with a surface active agent or a mixture of surface active agents that selectively adheres to one of the components present in the ore to the substantial exclusion of adhering to the other components present. The surface active agent is used in sufficient quantity to provide a thin film on the components of the ore towards which the surface active agent is reactive. Due to the surface chemical property of the components the surface active agent reacts only with the selected components within the ore.

The ore is conditioned with the surface active agent by mixing the surface active agent in a surface reactive relationship with the particulate ore. Conditioning of the ore with the surface agent is accomplished by contacting the particulate ore with the surface active agent. Many techniques are available for contacting a particulate solid with a liquid reagent. Such techniques include dipping the solid particles into a liquid bath containing the surface active agent, spraying the surface active agent onto the solid particles, mixing the solid particles with the surface active agent, and the like. The surface active agent can be used in any suitable manner such as in solution, suspension, dispersion, or by itself. It is preferred to form a dispersion of the surface active agent in water. Such a dispersion can be readily coated on the ore particles and water is an economical and readily available dispersant. The particulate ore is passed through such an aqueous dispersion bath to condition the ore with the surface active agent. In the dispersion bath the surface active agent interacts with those particles of the ore having surface chemical properties that are receptive to the surface active agent. Following the aqueous dispersion bath, the particulate ore is washed with an aqueous wash to remove excess surface active agent and any surface active agent entrained within the particulate ore.

Following conditioning of ore with the surface active agent the ore is mixed with a coloring agent. The coloring agent can be a liquid or solid dye or a liquid or solid pigmenting material which provides a distinctive color by itself or upon coupling with the surface active agent. It is preferred to use a solid coloring agent to minimize extraneous coating of the particles non-receptive to the surface active agent. It is preferred to use a coloring agent that is water insoluble. Water soluble coloring agents can dissolve in any water present during the conditioning of the ore and thereby impart the characteristic color of the coloring agent to components of the ore which are not coated with the surface active agent and to those particles which are coated with the surface active agent. For example, some components of ore can form a coating of water on their surface. This aqueous surface coating on the particles can absorb some of the coloring agent if the coloring agent is water soluble thereby imparting such color to such an aqueous coated particle. It would then be difficult to distinguish between the colored aqueous coated particles and the colored surface active coated particles. Use of a nonaqueous coloring agent that has an affinity toward the surface active agent substantially inhibits the formation of a color coating on particles which are not coated with the surface active agent. A coloring agent is also selected which is unreactive with the surface chemical properties of the components in the ore which are nonreceptive to the coupling agent.

The coloring agent can be provided in any suitable form such as in solution, dispersion, suspension or by itself. It is preferred to use the coloring agent dispersed in a suitable dispersant. The conditioned particulate ore coated with the surface active agent can be contacted with the coloring agent by any suitable means such as by dipping the ore particles into a dispersion bath containing the coloring agent, spraying the coloring agent onto the ore particles, intermixing the coloring agent with the ore particles and the like. As the water insoluble coloring agent comes into contact with the coated ore particles, the coloring agent, because of its affinity toward the surface active agent, adheres to the surface active agent coating the ore particles. The excess coloring agent, and that physically entrained in the ore particles, can be washed from the ore particles and can be recycled for use in the color coating of additional ore particles.

In another embodiment of the method of this invention, the coloring agent can be mixed with the surface active agent before conditioning the ore with the surface active agent. Thereby, as the ore is conditioned with the selective surface active agent, the particles receptive to the surface active agent are simultaneously provided with a color distinct from the color of the remaining particles.

Following the conditioning of the ore with the surface active agent and the coloring agent, there is formed two fractions of ore particles. One fraction, coated with the surface active agent coupled with coloring agent, has the color of the coloring agent. The second fraction is substantially the non-coated particles which retain their natural color. The coated, distinctly colored particles can be readily separated from the non-coated, natural colored particles by many different means, such as by hand sorting or by the use of an optical sorting device.

In a particular practice of the method of this invention in regard to limestone-bearing ore, limestone can be separated from quartz which can be present in the ore. The limestone-bearing ore is first crushed to a particle size of greater than one-half inch. Generally, the ore is crushed to a size range of from about one-half to about eight inches. Depending on whether the quartz or the limestone is to be coated with a color other than the natural white or gray color of the quartz and limestone, a selective surface active agent is selected which will adhere to either the limestone or quartz. If the quartz is to be coated with the selective surface active agent, a surface active agent can be selected from aliphatic amines or a mixture thereof containing from about 8 to about 22 carbon atoms and beta amines or mixtures thereof containing from about 7 to about 21 carbon atoms. Aliphatic amines useful in the practice of the method of this invention include octyl amine, decyl amine, dodecyl amine, tetradecyl amine, hexadecyl amine, octyldecyl amine, eicosanyl amine, docosanyl amine, and the like. Beta amines can include commercially available beta amines such as ARMEEN L-7 through L-15 series, which are registered trademark products of Armak Chemicals and are commonly known to those skilled in the art. Generally, the amines containing more than about 22 carbon atoms are not as selective as the amines containing less than about 22 carbon atoms. Aliphatic amines of less than about eight carbon atoms and beta amines of less than about seven carbon atoms generally do not have the desired coating properties. It is preferred to use an aliphatic amine containing from about 10 to about 18 carbon atoms and a beta amine containing from about 7 to about 15 carbon atoms. The above mentioned aliphatic and beta amines selectively coat the silicates present in limestone ore substantially to the exclusion of coating the calcium carbonate present in the limestone particles present.

An aqueous dispersion bath of the aliphatic and beta amines can be formed by mixing at least one of the above amine agents in water. The ore particles are passed through the aqueous dispersion bath or sprayed with the dispersion and thereby conditioned with the amine. Following the conditioning of the ore particles, they are contacted with a coloring agent such as activated carbon. The activated carbon can be in any convenient form for mixing with the conditioned particles such as in an aqueous suspension. The activated carbon substantially adheres to the amine-coated silicate particles present in the limestone ore and substantially does not adhere to the non-coated limestone particles present in the ore. The particulate limestone-bearing ore is then washed with water to remove excess amine surface active agent and excess activated carbon coloring agent. The quartz particles present retain the activated carbon which imparts a black/grayish color to the particles. The limestone particles retain their natural characteristic white color. The quartz particles can, therefore, be separated from the limestone particles by such contrast in color of the particles.

When the limestone particles are to be coated and colored, a surface active agent can be selected from saturated and unsaturated carboxylic acids, including fatty acids, which contain from about 5 to about 22 carbon atoms, or a mixture thereof. Carboxylic acids that can be used include palmitoleic acid, oleic acid, linoleic acid, caproic acid, caprylic acid, capric acid, myristic acid, palmitic acid, stearic acid, arachidic acid, behenic acid, tall oil fatty acids and the like. It is preferred to use at least one carboxylic acid containing from about 8 to about 18 carbon atoms. Carboxylic acids containing more than about 22 carbon atoms can be used, but generally tend to be less selective and thereby coat both limestone and quartz particles. Carboxylic acids of less than five carbon atoms generally do not possess the ability to coat any of the particles to any substantial degree.

The limestone-bearing ore can be coated with one of the above carboxylic acids by preparing an aqueous dispersion bath of the acid and dipping the ore particles therein. Following conditioning of the particles with the carboxylic acid dispersion the limestone particles are substantially coated with the carboxylic acid and the quartz present in the limestone ore is substantially not coated with the carboxylic acid. The conditioned ore is then treated with a coloring agent which has an affinity toward the carboxylic acid coating the calcium carbonate in the limestone particles. Such a coloring agent can be carbon black. The carbon black adheres substantially to the carboxylic acid coated limestone particles and substantially does not adhere to the non-coated quartz particles.

The limestone-bearing ore is then washed with an aqueous wash to remove excess carboxylic acid and any excess carbon black coloring agent. The limestone particles retain the carbon black which provides a black/grayish color with black spots to the limestone particles. The quartz particles retain their original white color. The contrasting particles of the limestone ore can, therefore, be separated by the contrast in color between the limestone particles and the quartz particles.

The invention is further illustrated by the following examples, which are not intended to be limiting.

EXAMPLE 1

A quantity of crushed limestone-bearing ore consisting of about 50 percent by weight quartz and about 50 percent by weight limestone with an average particle size of from about one-half inch to about eight inches is conditioned with a surface active agent of a fatty amine. An aqueous dispersion is prepared by mixing the fatty amine with sufficient water to make about a 2 percent by weight fatty amine dispersion.

The limestone-bearing ore is conditioned with the fatty amine by passing the particulate ore through a bath of the aqueous, fatty amine dispersion. The ore particles are removed from the dispersion bath and are subsequently treated by dipping the conditioned particles into a coloring agent consisting of an aqueous dispersion which is one percent by weight activated carbon in water. The ore particles are then washed with a clean water wash for removing excess fatty amine and coloring agent.

The limestone particles are separated from the silicate particles by the difference in color between the particles. The limestone particles remain clean and white while the quartz particles are black/gray in color.

EXAMPLE 2

A quantity of crushed limestone-bearing ore consisting of about 50 percent by weight limestone and about 50 percent by weight quartz with an average particle size greater than about one-half inch is conditioned with a surface active agent that is selective for coating the limestone particles.

The surface active agent for coating the limestone particles is prepared by forming an aqueous dispersion which is about 2 percent by weight caprylic acid in water. The limestone-bearing ore is passed through a dispersion bath, wherein the caprylic acid selectively coats the calcium carbonate in the limestone particles to the substantial exclusion of coating the silicate particles. The ore particles conditioned with the caprylic acid are mixed with an aquoeus dispersion that is about one percent by weight carbon black. The ore particles are then washed with an aqueous wash to remove any excess caprylic acid and any excess carbon black retained by the particles.

After the aqueous wash the limestone particles are separated from the quartz particles by the difference in color between the particles. The limestone particles are coated with caprylic acid which has retained carbon black and therefore are black/grayish in color with black spots while the quartz particles rinse clean to their natural white color.

What is claimed:

1. A method of separating a mixture of ore particles consisting of particles containing different ore components comprising the steps of:

(a) conditioning the mixture of ore particles by contacting the mixture with at least one selective surface-active agent capable of selectively coating those particles containing a component receptive to the surface active agent to the substantial exclusion of coating those particles containing a component non-receptive to the surface active agent and combining said surface active agent, with a solid coloring agent having an affinity toward such surface active agent in a quantity sufficient to provide upon combining a color distinguishable from the color of the non-coated particles; and (b) separating the color distinguishable coated ore particles from the non-coated ore particles.

2. A method as recited in claim 1 wherein the solid coloring agent is selected from the group consisting of carbon black and activated charcoal.

3. A method as recited in claim 1 wherein the coloring agent is combined with the surface active agent before contitioning the ore with the surface active agent.

4. A method as recited in claim 1 wherein the coloring agent is combined with the surface active agent after conditioning the ore with the surface active agent.

5. A method of separating a mixture of higher grade limestone from lower grade limestone and the silicate containing gangue present in particulate limestone ore comprising the steps of:

(a) conditioning the particulate limestone by contacting it with at least one surface active agent selected from the group consisting of aliphatic amines containing from about 8 to about 22 carbon atoms and beta amines containing from about 7 to about 21 carbon atoms, said surface active agent selectively coating the silicates in the gangue to the substantial exclusion of coating the calcium carbonate containing particles;

(b) combining with said surface active agent a coloring agent selected from the group consisting of carbon black, activated charcoal and mixtures thereof for providing the coated silicate containing gangue and lower grade limestone particles with a grayish-to-black color, leaving the higher grade limestone particles substantially in their natural color; and (c) separating the gray to black gangue and lower grade limestone particles from the higher grade limestone particles.

6. The method as recited in claim 5 wherein the surface active agent is an aliphatic amine containing from about 8 to about 22 carbon atoms.

7. The method as recited in claim 5 wherein the surface active agent is a beta amine containing from about 7 to about 21 carbon atoms.

8. A method for the separation of higher grade limestone particles from lower grade limestone particles and the gangue present in particulate limestone ore comprising the steps of:

(a) conditioning the particulate limestone ore by contacting with at least one surface active agent selected from saturated and unsaturated carboxylic acids containing from about 4 to about 22 carbon atoms, said surface active agent coating the calcium carbonate in the limestone to the substantial exclusion of coating the gangue;

(b) combining with said surface active agent a coloring agent selected from the group consisting of activated charcoal, carbon black and mixtures thereof for providing the coated limestone particles with a gray-to-black color, leaving the gangue particles substantially in their natural color; and (c) separating the higher grade black limestone particles from the lower grade gray limestone particles and the gangue.

9. The method as recited in claim 8 wherein the saturated and unsaturated carboxylic acid contains from about 8 to about 18 carbon atoms.

10. A method of separating a mixture of higher grade limestone from lower grade limestone and silicate containing gangue present in particulate limestone ore comprising the steps of:

(a) conditioning the particulate limestone ore with at least one surface active agent selected from the group consisting of aliphatic amines containing from about 8 to about 22 carbon atoms and beta amines containing from about 7 to about 21 carbon atoms, said surface active agent selectively coating silicates to the substantial exclusion of coating calcium carbonate, providing a coating on gangue and lower grade limestone particles to the substantial exclusion of providing a coating on higher grade limestone particles;

(b) combining with said surface active agent a solid coloring agent having an affinity toward said surface active agent for providing the coated silicate containing gangue and lower grade limestone particles with a distinguishable color from the higher grade limestone particles substantially in their natural color; and (c) separating the gangue and lower grade limestone particles from the higher grade limestone particles.

11. The method as recited in claim 10 wherein the surface active agent is an aliphatic amine containing from about 8 to about 22 carbon atoms.

12. The method as recited in claim 10 wherein the surface active agent is a beta amine containing from about 7 to about 21 carbon atoms.

13. A method for the separation of higher grade limestone particles from lower grade limestone particles and the gangue present in particulate limestone ore comprising the steps of:

(a) conditioning the particulate limestone ore with at least one surface active agent selected from saturated and unsaturated carboxylic acids containing from about 4 to about 22 carbon atoms, said surface active agent selectively coating calcium carbonate in the higher grade and lower grade limestone particles to the substantial exclusion of coating gangue particles;

(b) combining with said surface active agent a solid coloring agent having an affinity toward said surface active agent for providing the coated higher grade and lower grade limestone particles with a distinguishable color, leaving gangue particles substantially in their natural color; and (c) separating the higher grade limestone particles from the lower grade limestone particles and the gangue.

14. The method as recited in claim 8 wherein the saturated and unsaturated carboxylic acid contains from about 8 to about 18 carbon atoms.

* * * * *

UNITED STATES PATENT AND TRADEMARK OFFICE

CERTIFICATE OF CORRECTION

PATENT NO. : 4,235,708

DATED : November 25, 1980

INVENTOR(S) : Brij M. Moudgil, Booker W. Morey and David F. Messenger

It is certified that error appears in the above—identified patent and that said Letters Patent is hereby corrected as shown below:

Column 2, line 35, change "are" to -- ore --.
Column 4, line 58, after "active" insert -- agent --.
Column 5, line 25, change "is" to -- are --.
Column 7, line 41, change "aquoeus" to -- aqueous --.
Column 7, line 64, delete "combining" and insert -- applying to --.
Column 7, line 64, delete the word "with" and delete the word "solid".
Column 7, line 65, after "agent" insert -- consisting essentially of solids --.
Column 8, line 17, after "limestone" insert the word -- ore --.
Column 8, line 49, after "contacting" insert -- it --.
Column 9, line 3, after "ore" insert -- by contacting it --.
Column 10, line 8, after "ore" insert -- by contacting it --.
Column 10, line 25, change "8" to -- 13 --.

Signed and Sealed this

*Twelfth* Day of *May 1981*

[SEAL]

*Attest:*

RENE D. TEGTMEYER

*Attesting Officer*

*Acting Commissioner of Patents and Trademarks*